United States Patent [19]

Im

[11] Patent Number: 4,904,103

[45] Date of Patent: Feb. 27, 1990

[54] LOOSE-LEAF BINDER

[76] Inventor: Darryl Im, 9441 Imperial Ave., Garden Grove, Calif. 92644

[21] Appl. No.: 283,727

[22] Filed: Dec. 13, 1988

Related U.S. Application Data

[63] Continuation-in-part of Ser. No. 132,781, Dec. 14, 1987, abandoned.

[51] Int. Cl.[4] ..... B42D 13/24; B42D 13/26

[52] U.S. Cl. ..... 402/35; 402/37; 402/38; 402/39; 402/41; 402/60

[58] Field of Search ..... 402/30, 31, 34, 35, 402/37, 36, 38, 60, 56, 80 P

[56] References Cited

U.S. PATENT DOCUMENTS

| | | | |
|---|---|---|---|
| 2,041,168 | 5/1936 | Dawson | 402/38 |
| 2,311,090 | 2/1943 | Schade | 402/39 |
| 2,511,153 | 6/1950 | Emmer | 402/41 X |
| 3,205,895 | 9/1965 | Johnson | 402/38 |
| 4,349,289 | 9/1982 | Cardellini | 402/34 |
| 4,355,916 | 10/1982 | Cardellini | 402/41 |
| 4,441,834 | 4/1984 | Cardellini | 402/41 X |
| 4,552,478 | 11/1985 | Cohen | 402/39 |

FOREIGN PATENT DOCUMENTS

| | | | |
|---|---|---|---|
| 8200114 | 1/1982 | World Int. Prop. O. | 402/60 |

*Primary Examiner*—Paul A. Bell
*Attorney, Agent, or Firm*—Boniard I. Brown

[57] ABSTRACT

A binder for releasibly retaining pages as well as covers which include a plurality of mating pairs of semicircular rings whose peripheries essentially are all exposed so that the paper or covers can be extended therefrom essentially 360 degrees therearound. The mating pairs of semicircular rings are forced together or retained in an open position either by an overcenter mechanism at their inner end or a lockable hinge structure, either one of which extends primarily within the peripheries of the semicircular ring pairs when they are in their closed positions.

19 Claims, 4 Drawing Sheets

LOOSE-LEAF BINDER

RELATED APPLICATIONS

This application is a continuation-in-part of application Ser. No. 07/132,781, filed Dec. 14, 1987, now abandoned.

BACKGROUND OF THE INVENTION

Many loose-leaf binding mechanisms are known in the art. For example, a traditional binder mechanism is shown in DAWSON, U.S. Pat. No. 2,041,168, wherein semicircular ring members have inner ends joined to an overcenter mechanism of a spine to which a binder cover is attached. Other overcenter loose-leaf binder mechanisms are disclosed in SCHADE, U.S. Pat. No 2,311,090, EMMER, U.S. Pat. No. 2,511,153, and COHEN, U.S. Pat. No. 4,552,478. A loose-leaf binder with a spine including cam closure rather than an overcenter closure is shown in JOHNSON, U.S. Pat. No. 3,205,895. In all of these binder mechanisms, the ring members are movable between open positions wherein their outer free ends are spaced to receive loose-leaf paper, dividers, etc., and closed positions wherein the corresponding free ends of the ring members are juxtaposed to form closed coaxial rings with the free ring member ends disposed substantially in a common plane containing the common axis of the closed rings and referred to herein as the central plane of the closed rings. The spine has a transverse cross-section whose major dimension is transverse to this central plane of the closed rings such that the spine reduces the effective ring circumference available to contain loose-leaf paper, dividers, and the like, to substantially less than 360 degrees.

Other binder constructions, such as those disclosed in V. E. CARDELLINI, U.S. Pat. Nos. 4,349,289, 4,355,916, and 4,441,834 have binder rings mounted on essentially flat spine members whose major dimension (width) is disposed substantially in the central plane of the closed binder rings, whereby substantially the full 360 degree circumference of the rings is available to contain loose-leaf papers, dividers and the like. The spine members of these latter binder constructions, however, are joined by a complex mechanism for opening and closing the rings to insert or remove papers. Published International application PC/BR81/00003 (International Publication Number WO/ 8200114) discloses a binder construction having an essentially flat spine disposed substantially in the central plane of the closed binder rings and comprising spine members hingeably joined to one another, whereby the binder ring members are rotatable between their open and closed positions. A removable channel member straddles the spine members to lock the binder rings closed. A distinct disadvantage of all of the latter binder constructions with hinged binder members is that each spine member and its ring members are integrally formed from flat sheet stock. This results in a spine member with relatively thin wide ring members extending from an edge of the spine member which will not rreceive standard multi-hole loose-leaf paper. Moreover, the spine hinge connections are between the binder ring members and not the spine members directly and are quite loose.

Therefore, there is a need for a simple, easy to manufacture ring binder which allows papers and covers to extend essentially 360 degrees therefrom for ease of use and removal of the papers and the covers without a large number of complex parts which may become broken.

SUMMARY OF THE INVENTION

This invention provides an improved loose-leaf binder construction which fulfills the above and other binder requirements. Generally stated, the invention provides a loose-leaf binder construction including pairs of ring members having inner and outer ends and pivotally joined at their inner ends by a spine for rotation of the ring members between closed and open positions. In the closed positions of the ring members, the outer ends of the ring member pairs are juxtaposed to form binder rings. In the closed positions of the ring members, the outer ends of the ring member pairs are spaced to permit placement and removal of loose-leaf papers, dividers, covers, and the like on and from the binder rings. The spine has major and minor transverse dimensions and is disposed with its major dimension substantially parallel to the central plane of the closed binder rings (i.e., a plane containing the outer ends of the ring members and the central axis of the closed binder rings).

According to a preferred feature of the invention, the ring members rotate between their open and closed positions about an effective pivot axis located close to or substantially along one longitudinal edge of the spine and outside the circumference of the closed binder rings, and the spine projects radially into the rings in the central plane of the rings. Accordingly, at least most of the spine is disposed within the rings, almost the entire 360 degree circumference of the rings is available to receive standard multi-hole loose-leaf sheets, covers, etc., and the rings can be opened widely to facilitate placement of sheets on and removal of sheets from the rings.

Several presently preferred embodiments of the invention are disclosed, all having binder ring members formed from slender but rigid metal rods for receiving standard multi-hold loose-leaf sheets. In certain of these embodiments, the spine includes an overcenter mechanism to which the inner ends of the binder ring members are operatively connected. This overcenter mechanism effects opening and closing movement of the ring members with a snap action. In the other disclosed embodiments, the binder spine includes two rigid elongate spine members which are pivotally joined along their longitudinal edges and to which the binder ring members are rigidly joined, whereby the ring members are opened and closed by rotation of the spine members about their pivot axis. Various means are disclosed for retaining the spine members and thereby the ring members in their closed positions.

Therefore it is an object of the present invention to provide an economical loose-leaf binder structure which allows a wide range of paper and cover movement.

Another object is to provide a secure loose-leaf binder structure which is extremely economical to manufacture.

Another object is to provide a loose-leaf binder structure which can accommodate various numbers and spacings of rings.

Another object is to provide a loose-leaf binder structure which is robust and able to take hard use.

These and other objects and advantages of the present invention will become apparent to those skilled in the art after considering the following Specification and drawings wherein:

DETAILED DESCRIPTION OF THE PREFERRED EMBODIMENT

Figure 1:
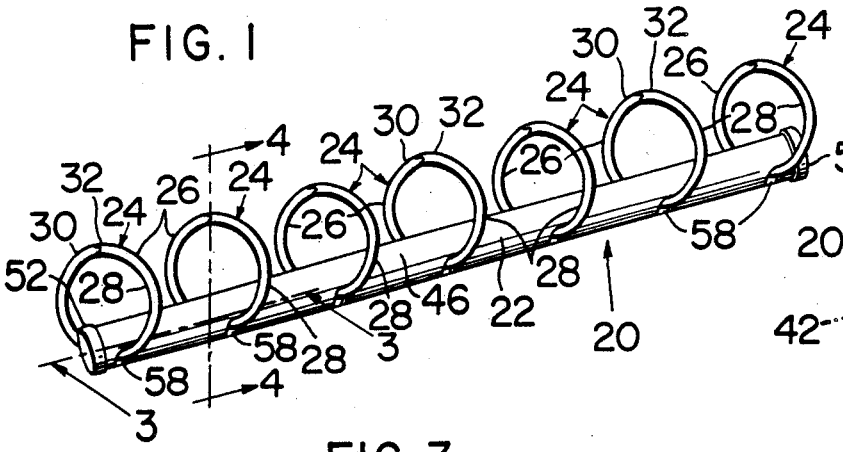
FIG. 1 is a perspective view of a loose-leaf binder structure according to the present invention in its closed position.
Figure 2:
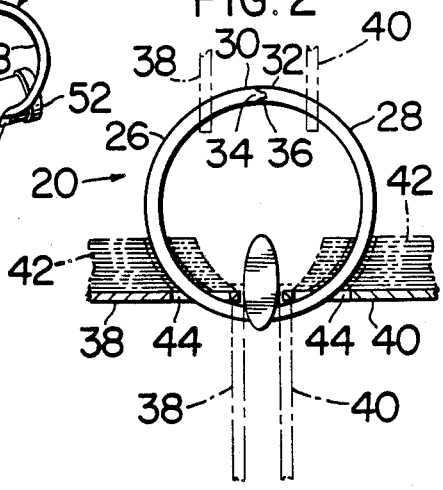
FIG. 2 is an enlarged end view of the binder of FIG. 1 showing various possible positions of covers and papers retained on the binder.
Figure 4:
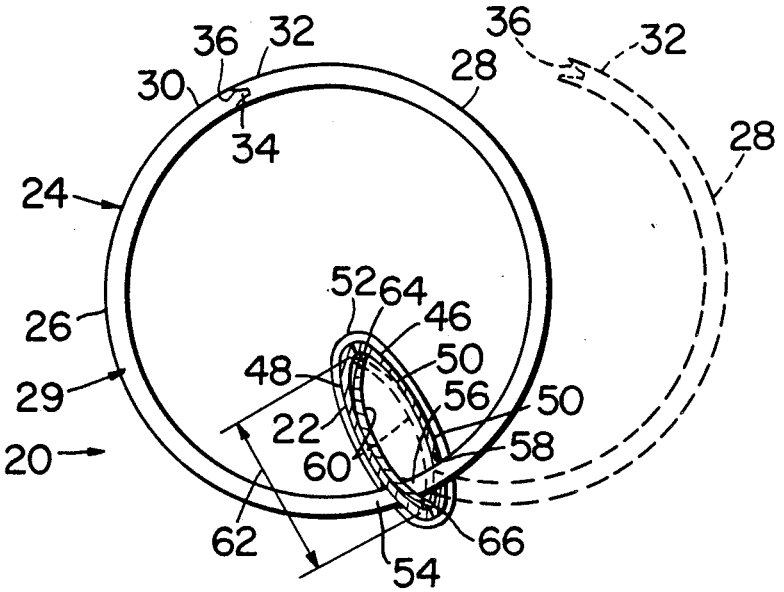
FIG. 4 is an enlarged cross-sectional elevational view taken on line 4—4 of FIG. 1.

Referring to the drawings more particularly by reference numbers, number 20 in FIG. 1 refers to a loose-leaf binder constructed according to the present invention. The binder 20 includes a spine 22 which retains a plurality of ring member pairs 24. Each of the ring pairs 24 include a fixed generally semicircular ring member 26 and a movable semicircular ring member 28. As shown in FIG. 4, the semicircular ring members 26 and 28 have open and closed positions and when closed form circular binder rings 29. The semicircular ring members 26, 28 have inner ends connected by the spine 22 and outer ends 30 and 32 constructed with a tongue 34 and groove 36 which assures that the semicircular ring members 26 and 28 remain in circular registration when closed. In FIG. 2, the binder 20 is retaining a pair of covers 38 and 40 as well as a quantity of loose-leaf paper 42. The paper 42 and the covers 38 and 40 include suitable holes 44 therethrough to allow passage of the semicircular ring members 26 and 28. The spine 22 is generally elliptical in transverse cross-section and thus has mutually perpendicular major and minor transverse axes and dimensions. The spine is disposed with its major transverse axis disposed in a central plane of the closed binder rings 29 containing the common central axis of these rings and the outer ends 30, 32 of the ring members 26, 28. As will appear from the ensuing description, the spine 22 pivotally or hingeable joins the ring members 26, 28 for generally rotational opening and closing movement of these members about a pivot axis close to or substantially along a major longitudinal edge of the spine. The major longitudinal axis or width of the spine extends radially in from this edge toward the common axis of the closed binder rings 29. Accordingly, the spine is disposed primarily within the area defined by the closed rings 29 and the circumferential extent of the rings is almost a full 360 degrees, whereby the covers 38 and 40, and the papers 42, can extend from the closed rings in any radial direction throughout almost a full 360 degrees.

Figure 3:
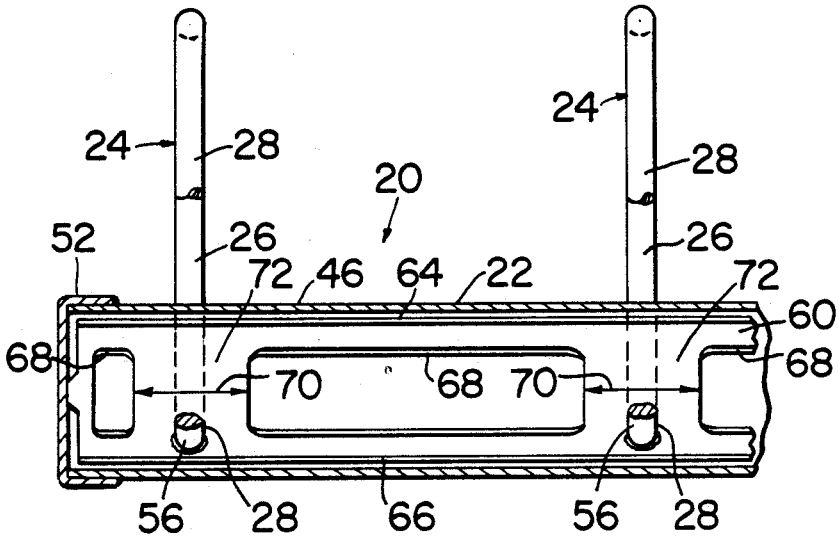
FIG. 3 is an enlarged cross-sectional view taken on line 3—3 in FIG. 1.

As shown in FIGS. 3 and 4, the spine 22 includes first spine member in the form of an elliptical casing 46 having two opposite relatively narrow longitudinal edges spaced along the major transverse axis of the casing and relatively broad sides between these edges. The casing is composed of two casing half portions 48 and 50 held together by suitable means such as the end caps 52. The fixed semicircular ring members 26 are connected at their inner ends 54 to the broad side surface of the casing portion 48. The movable semicircular ring members 28 have inner ends 56 which extend through holes 58 in the broad side of casing portion 50 and are attached to a second spine member 60 retained within the casing 46. Spine member 60 is a spring plate having two opposite longitudinal edges 64, 66 disposed in pivotal contact with interior longitudinal surfaces of the casing 46 along its relatively narrow longitudinal edges. The spring member 60 is substantially flat in its normal relaxed conditin. As shown in FIG. 4, the inner major dimension 62 of the elliptical casing 46 between these interior casing surfaces is slightly smaller than of the relaxed width from edge 64 to edge 66 of the spring member 60. Therefore, the spring member 60 can take only the stable positions shown in full and dashed outline in FIG. 4. The full lines show the closed position and the dashed lines show the open position of the binder 20. The spring member 60 and its confining spine casing 46 thus constitute a snap action over center spine assembly which pivotally or hingeably connects the ring members 26, 28 for snap action rotational movement of the ring members between their open and closed positions during which the spring member is bowed to one side or the other, as shown in solid and dashed lines in FIG. 4. As shown in FIG. 3, the spring member 60 may have cutouts 68 therealong to reduce the force required to move it overcenter between its solid and dashed line positions and thereby the force required to open and close the ring members 26, 28. The snap action strength of the spring member 60 is determined by the width 70 of the spring columns 72 between the cutouts 68.

It is evident from the foregoing description and from FIG. 4 that the casing 46 to which the ring members 26 are rigidly joined and the spring 60 to which the ring members 28 are rigidly joined form a snap action overcenter spine assembly pivotally connecting the ring members. The outer edge 66 of the spring or spine member 60 pivotally engages the inner wall of the spine casing or member 46 to form, in effect, a pivotal connection between the spine members about which opening and closing movement of the ring members 26, 28 occurs. Accordingly, this opening and closing movement of the binder ring members is essentially a rotational movement substantially about an axis extending along the outer edge 66 of the spring or spine member 60. This pivot axis is situated outside the circumference of the closed binder rings 29 and substantially along the outer major longitudinal edge of the elliptical spine 22 (i.e., the lower small diameter rounded edge of the elliptical spine casing 46 in FIG. 4).

Figure 5:
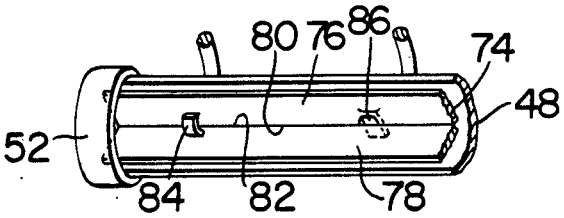
FIG. 5 is a fragmentary perspective view of a modified spine structure of the present invention.
Figure 6:
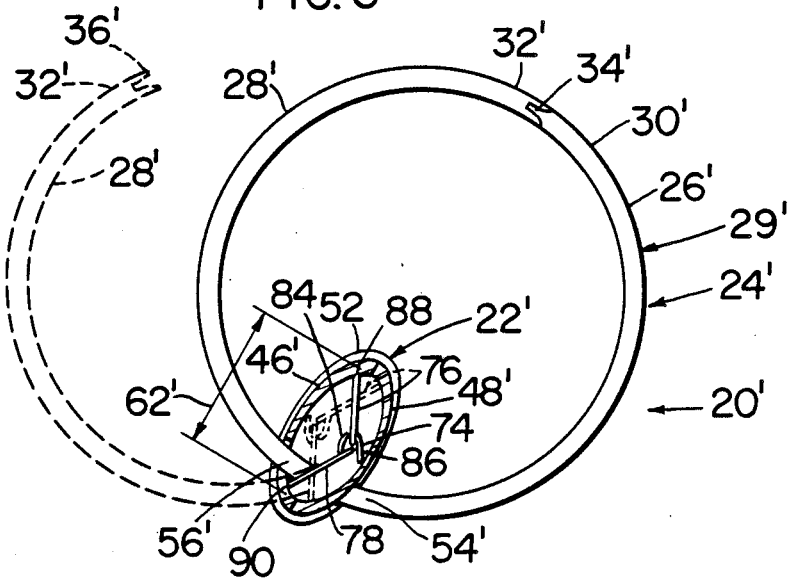
FIG. 6 is a cross-sectional view similar to FIG. 4 through the embodiment of FIG. 5.

The binder construction shown in FIGS. 5 and 6 is identical to that of FIGS. 1–4 except that a different spring member 74 is used including a pair of spring plates 76 and 78. The spring plates 76 and 78 are retained in inner edge 80 to inner edge 82 contact by tabs 84 and 86 formed out of the inner edges 80 and 82 respectively. As shown in FIG. 6, the overall outer edge 88 to outer edge 90 dimension of the spring member 74 when its spring plates 76, 78 are disposed in coplanar relationship is larger than the inner major dimension 62' of the casing 46'. Therefore the spine casing 46' and spring member 74 constitute a snap action over center spine assembly having the two stable positions shown in solid and dashed lines in FIG. 6. Ring members 26' are rigidly joined to the spine casing 46'. Ring members 26' are rigidly joined to a broad side of casing 46'. Ring members 28' are rigidly joined to a broad side of the outer spring plate 78. The ring members are movable with a snap action over center movement between a stable open position shown in dashed lines and a stable closed position shown in solid lines in FIG. 6.

As in FIGS. 1–4, the elliptical spine casing 46' to which the ring members 26' are rigidly joined and the spring member 74 to which the ring members 28' are rigidly joined form spine members mounting the ring members for opening and closing movement. This opening and closing movement of the ring members 26', 28' is essentially a rotational movement which occurs substantially about an axis extending along the outer edge 90 of the outer spring plate 78 and situated outside the circumference of the closed binder rings 29' and substantially along the outer longitudinal edge of the elliptical spine 22' (i.e., the lower edge of the spine casing 46' in FIG. 6).

Figure 7:
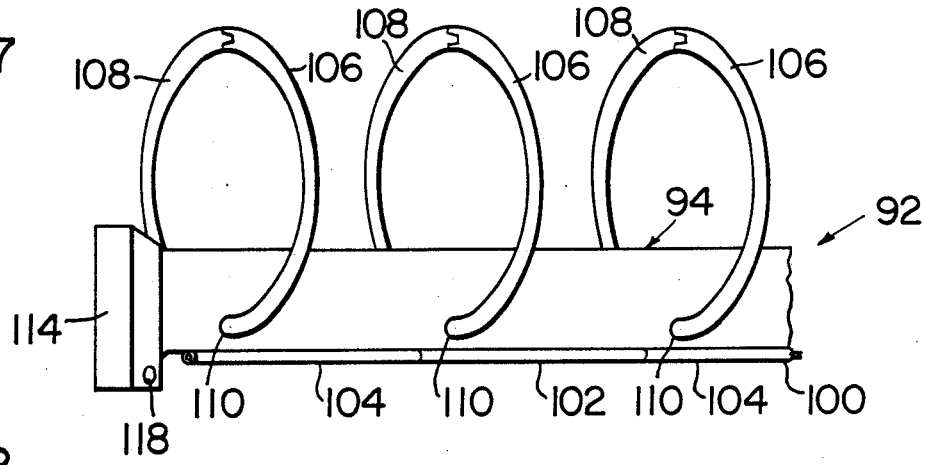
FIG. 7 is a fragmentary perspective view of another embodiment of the invention in its closed position.
Figure 8:
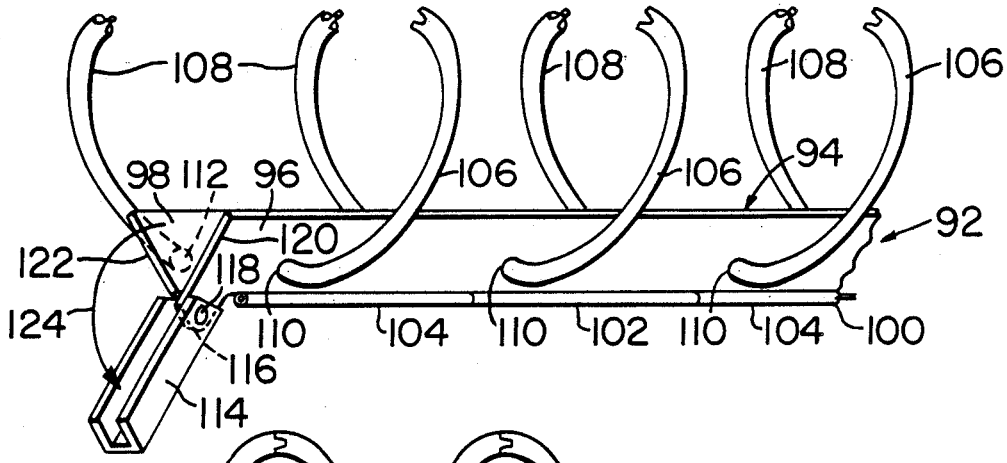
FIG. 8 is a perspective view of the embodiment of FIG. 7 in its open position.
Figure 9:
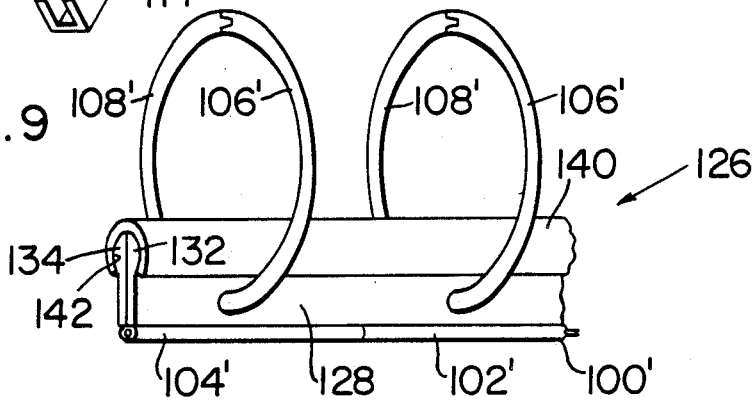
FIG. 9 is a fragmentary perspective view of another embodiment of the invention in its closed position.

A modified binder embodiment 92 is shown in FIGS. 7 and 8. In binder 92, the spine 94 includes a pair of relatively rigid spine members in the form of plates 96 and 98 which are pivotally joined by a piano hinge 100 along their outer longitudinal edges 102 and 104. Semicircular ring members 106 and 108, similar to ring members 26 and 28, are rigidly joined at their inner ends 110, 112 to the spine plates 96 and 98 adjacent the hinge 100. A locking device 114, shown as a channel member, is pivotally attached to a tang 116 on plate 96 by a pivot pin 118. The locking channel 114 is rotatable to a closed or locking position shown in FIG. 4 wherein the channel engages over the ends 120 and 122 of the spine plates 96 and 98 to retain the ring members 106 and 108 in their illustrated closed positions, wherein they form binder rings. When the channel member 114 is swung open in the direction of the arrow 124 in FIG. 8, the spine plates 96 and 98 are free to rotate about the hinge 100. Such rotation opens the ring members 106 and 108. As in the embodiments of FIGS. 1–6, opening and closing movement of the ring members is a rotational movement which occurs about a pivot axis located along a longitudinal edge of the spine 94 and outside the circumference of the closed binder rings.

Figure 10:
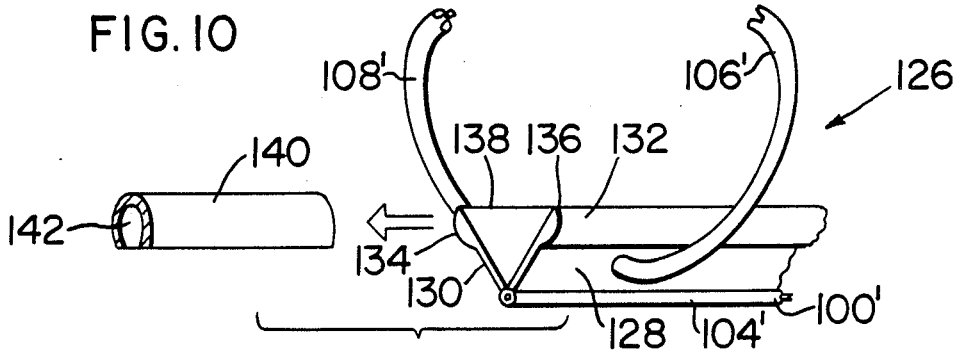
FIG. 10 is an exploded perspective view of the embodiment of FIG. 9 in its open position.

FIGS. 9–17 illustrate further modified binder constructions according to the invention which are essentially identical to that of FIGS. 7 and 8 except for the locking means for securing the hinged spine members or plates 128, 130 and binder ring members 106', 108' in their closed positions. Thus, in the binder of FIGS. 9 and 10, the spine plates 128 and 130 have laterally projecting ribs 132 and 134 along their free longitudinal edges 136 and 138. The ribs 132 and 134 have a semicircular cross-section. A locking channel member 140, having a somewhat greater than semicircular channel 142 is slidable over the ribs 132 and 134 when the plates 128 and 130 are together to secure the ring members 106' and 108' in their closed positions of FIG. 9. When the channel member 140 is slid endwise from the spine plates, the ring members 106' and 108' can be opened as shown in FIG. 10.

Figure 11:
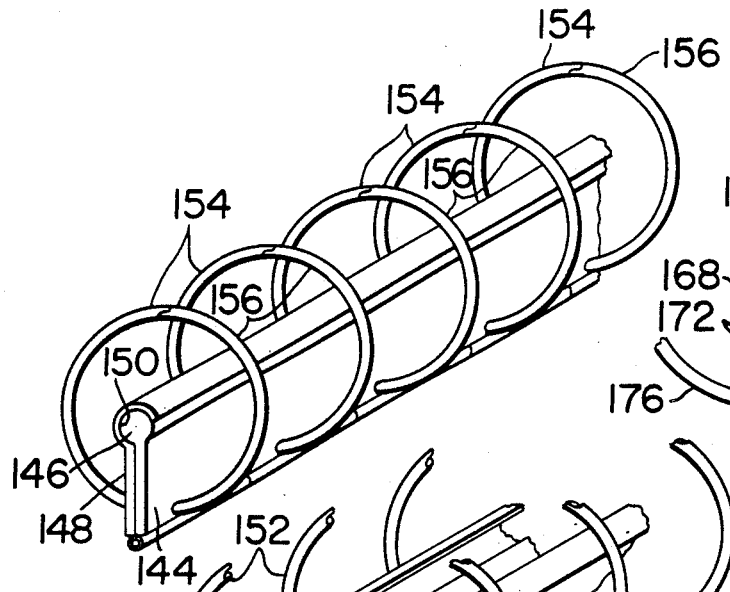
FIG. 11 is a perspective view of a further modified embodiment of the invention in its closed position.
Figure 12:
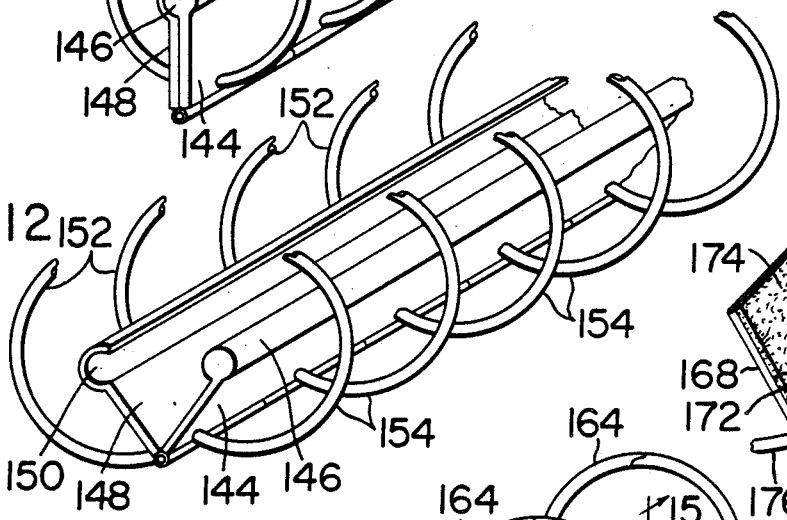
FIG. 12 is a perspective view of the embodiment of FIG. 11 in its open position.

In FIGS. 11 and 12, one hinged spine plate 144 has a cylindrical locking bead 146 along its free longitudinal outer edge. The other spine plate 148 has a locking channel 150 along its free longitudinal edge which opens toward the locking bead 146 and is sized and shaped to receive the bead with snap fit for releasibly retaining the spine plates 144, 148 together and thereby the binder ring members 152, 154 in their closed ring-forming positions of FIG. 11.

Figure 13:
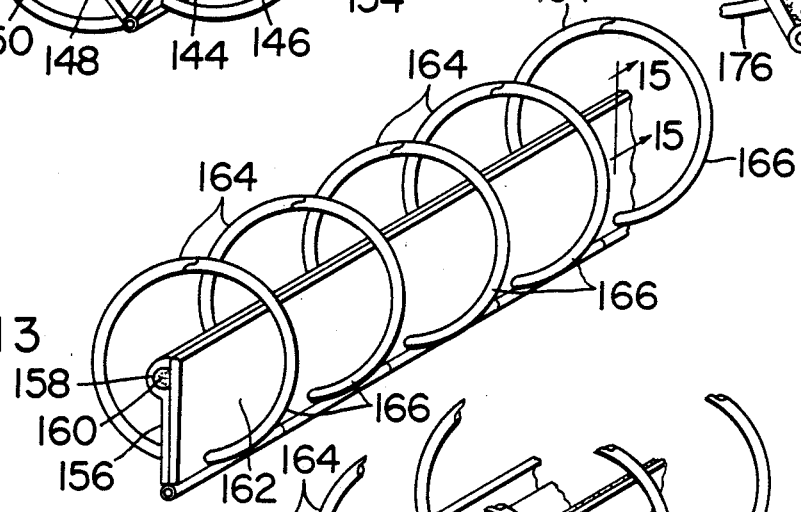
FIG. 13 is a perspective view of a further modified embodiment of the invention in its closed position.
Figure 14:
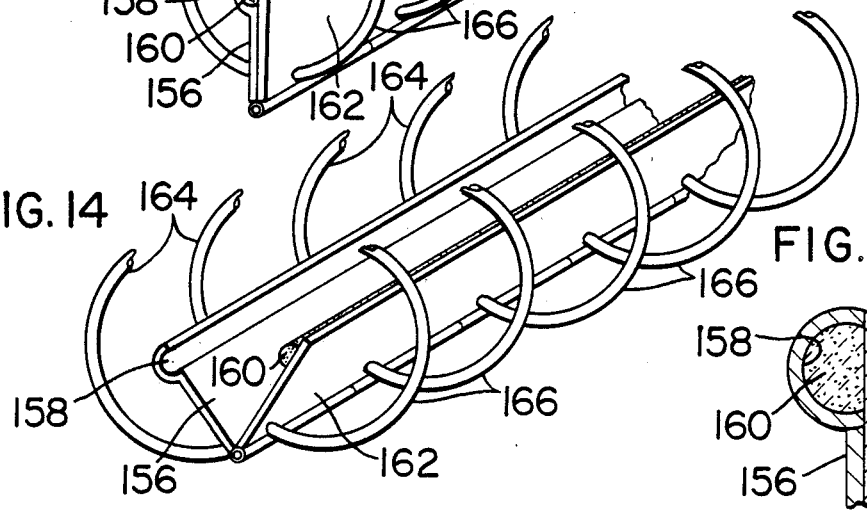
FIG. 14 is a perspective view of the embodiment of FIG. 13 in its open position.
Figure 15:
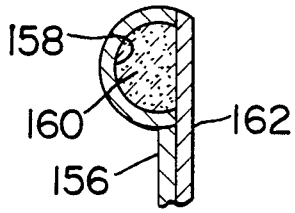
FIG. 15 is an enlarged section taken on line 15—15 in FIG. 13.

In FIGS. 13 through 15, one hinged spine plate 156 has a locking channel portion 158 along its outer edge which opens toward and is sized and shaped to receive a locking bead 160 secured to the other spine plate 162. The locking bead 160 is a permanent magnet, such as a ceramic magnet, and at least the channel portion 158 is constructed of a magnetic permeable material. When the spine plates 156, 162 are rotated to their closed positions of FIGS. 13 and 15, the magnetic locking bead 160 engages within the magnetic channel portion 158 to magnetically secure the spine plates and thereby the binder ring members 164, 166 closed. If desired, the magnetic locking channel 158 may be sized and shaped to receive the magnetic locking beam 160 with a snap fit to provide both magnetic mechanical retention of the binder ring members 164, 166 in their closed positions.

Figure 16:
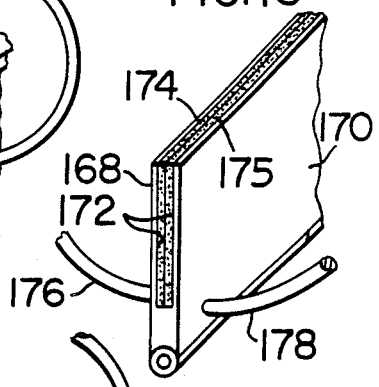
FIG. 16 is a fragmentary perspective view of a further modified embodiment of the invention in its close positions.
Figure 17:
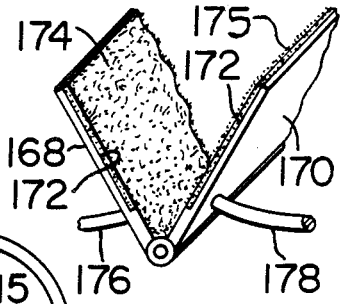
FIG. 17 is a fragmentary perspective view of the embodiment of FIG. 16 in its open position.

Finally, in FIGS. 16 and 17, the inner confronting surfaces of the hinged spine plates 168, 170 are recessed at 172 to receive mating hook and loop VELCRO pads 174, 175. These pads are secured to the spine plates by adhesive or in any other appropriate way. The depth of the recesses 172 and the thickness of the VELCRO pads are such that the pads enter into mutual interlocking engagement when the spine plates 168, 170 are rotated to their closed positions of FIG. 16, thereby securing these plates and hence also the binder ring members 176, 178 in their closed positions.

In all of the above described inventive embodiments, the binder ring members are formed from slender rigid metal rods of steel or the like.

Therefore, there has been show and described novel loose-leaf binder structures which fulfill all of the objects and advantages sought therefore. Many changes, modifications, variations and other uses and applications of the specific invention will, however, become apparent to those skilled in the art after considering the foregoing Specification together with the accompanying drawings and claims. All such changes, modifications, variations and other uses and applications which do not depart from the spirit and scope of the invention are deemed to be covered by the invention which is limited only by the claims which follow.

The inventor claims:

1. A loose-leaf binder comprising: a spine including a hollow casing having two opposite longitudinal edges, a major transverse dimension and relatively broad side surfaces between said edges, and a minor transverse dimension normal to said major dimension, and spine means contained within said casing for over-center movement of said spine means within said casing between first and second stable positions relative to said casing, and first ring members secured to one side surface of said casing adjacent one longitudinal edge of the casing and second ring members extending through the other side surface of said casing adjacent said one longitudinal edge of the casing and secured to said spine means with said first and second ring members aligned in pairs spaced along said spine and curving over the other longitudinal edge of the casing to form binder rings which are open when said spine means occupies its first stable position and are closed and encircle said spine when said spine means occupies its second stable position.

2. A loose-leaf binder according to claim 1 wherein:

said spine means comprises a resiliently bendable spring plate having longitudinal edges in contact with the interior surfaces of said casing along said longitudinal casing edges, and said spring plate having a width between said longitudinal plate edges slightly greater than the interior dimension of said casing between said interior casing surfaces, whereby said spring plate bows in one direction in said first stable position and in the opposite direction in said second stable position.

3. A loose-leaf binder according to claim 1 wherein:

said spine means comprises a pair of resiliently bendable spring plates having adjacent pivotally joined longitudinal edges and distal longitudinal edges disposed in contact with interior surfaces of said casing along said longitudinal casing edges, and said spring plates have a combined width between their distal longitudinal edges slightly greater than the interior dimension of said casing between said interior casing surfaces, whereby said spine bows in one direction in said first stable position and in the opposite direction in said second stable position.

4. A loose-leaf binder comprising:

an elongate spine comprising first and second elongate spine members each having two opposite longitudinal edges, relatively broad side surfaces and a major transverse dimension between said edges, and a substantially smaller minor transverse dimension normal to said major dimension, first and second ring members having inner and outer ends and rigidly joined at their inner ends to broad side surfaces of said first and second spine members, respectively, adjacent certain longitudinal edges of the spine members with the first and second ring members aligned in pairs spaced along said spine, and said ring members comprising curved rods which extend laterally out from their respective spine members and then curve back over the other longitudinal edges of the spine members with the outer ends of each ring member pair aligned to form binder rings, and wherein said spine members comprise coacting means totally independent of said ring members pivotally coupling said spine members for relative pivotal movement of said spine members and ring members on a pivot axis adjacent and parallel to said certain longitudinal edges of the spine members and between open positions wherein the aligned outer ring member ends are spaced to insert and remove loose leaf sheets into and from the binder and closed positions wherein the aligned outer ring member ends are juxtaposed to form closed binder rings encircling said spine.

5. A loose-leaf binder according to claim 4, wherein:

said spine comprises means for releasibly retaining said spine members and ring members in their closed positions.

6. A loose-leaf binder according to claim 4, wherein:

said spine members comprise over-center means for releasibly retaining said spine members and ring members in their open and closed positions.

7. A loose-leaf binder according to claim 1, wherein:

said spine includes means for releasibly securing said spine members to one another when said spine members and ring members occupy their closed positions, thereby to retain said binder rings closed.

8. A loose-leaf binder according to claim 7 wherein:

said spine members comprise elongate plates having opposite ends and first and second longitudinal edges and pivotally joined to one another along said first longitudinal edges, and said securing means comprises a lock member removably straddling said plates.

9. A loose-leaf binder according to claim 8 wherein:

said lock member comprises a channel member extending longitudinally of said plates and straddling the other longitudinal plate edges.

10. A loose-leaf binder according to claim 7, wherein:

said securing means comprise coacting releasibly engageable connecting means on said spine members, respectively.

11. A loose-leaf binder according to claim 10, wherein:

said connecting means comprises snap fastening means.

12. A loose-leaf binder comprising:

a spring member, a first semielliptical casing member pivotally connected to said spring member, ring members secured to said spring member and casing member, respectively, in positions to form binder rings, and a second semielliptical casing member through which said first ring members extend and which is joined to said first casing member to form a generally elliptical casing containing said spring member in a stressed condition for over-center movement of the spring member in said casing between a first stable position wherein said binder rings are open and a second stable position wherein said binder rings are closed.

13. A loose-leaf binder comprising:

an elongate spine having two opposite longitudinal edges, a major transverse dimension between said edges, and a substantially smaller minor transverse dimension normal to said major dimension, and said spine including first and second spine members which have relatively broad side surfaces between said spine edges and are relatively pivotally rotatable substantially about a longitudinal pivot axis adjacent one longitudinal edge of said spine, first and second ring members having inner and outer ends and rigidly joined at their inner ends to broad side surfaces of said first and second spine members, respectively, with the first and second ring members aligned in pairs spaced along said spine and the outer ring member ends of each pair aligned to form binder rings which are opened and closed by rotation of said said spine members and ring members substantially about said pivot axis between open positions wherein the aligned outer ring member ends are spaced to insert and remove loose leaf sheets into and from the binder and closed positions wherein the aligned outer ring member ends are juxtaposed to form closed binder rings, and wherein said spine members comprise elongate plates having opposite ends and longitudinal edges and pivotally joined to one another along one longitudinal edge of one plate and one longitudinal edge of the other plate, and said spine comprises a channel member pivotally mounted on one end of one spine plate for movement to and from a position wherein said channel member straddles the adjacent ends of said plates for releasibly securing said spine members to one another when said spine members and ring members occupy their closed positions, thereby to retain said binder rings closed.

14. A loose-leaf comprising:

an elongate spine having two opposite longitudinal edges, a major transverse dimension between said edges, and a substantially smaller minor transverse dimension normal to said major dimension, and said spine including first and second spine members which have relatively broad side surfaces between said spine edges and are relatively pivotally rotatable substantially about a longitudinal pivot axis adjacent one longitudinal edge of said spine, ring members having inner and outer ends and rigidly joined at their inner ends to broad side surfaces of said first and second spine members, respectively, with the first and second ring members aligned in pairs spaced along said spine and the outer ring member ends of each pair aligned to form binder rings which are opened and closed by rotation of said said spine members and ring members substantially about said pivot axis between open positions wherein the aligned outer ring member ends are spaced to insert and remove loose leaf sheets into and from the binder and closed positions wherein the aligned outer ring member ends are juxtaposed to form closed binder rings encircling a major portion of said spine, and wherein said spine members comprise elongate plates having opposite ends and first and second longitudinal edges and pivotally joined to one another along said first longitudinal edges, said spine comprises a channel member extending longitudinally of said plates and straddling said second longitudinal plate edges for releasibly securing said spine members to one another when said spine members and ring members occupy their closed positions, thereby to retain said binder rings closed, said channel member contains a longitudinal channel receiving said second longitudinal plate edges, said plates are laterally enlarged along their second longitudinal edges, and said channel is shaped and sized in transverse crossection to slidably receive said enlarged second longitudinal plate edges.

15. A loose-leaf binder comprising:

an elongate spine having two opposite longitudinal edges, a major transverse dimension between said edges, and a substantially smaller minor transverse dimension normal to said major dimension, and said spine including first and second spine members which have relatively broad side surfaces between said spine edges and are relatively pivotally rotatable substantially about a longitudinal pivot axis adjacent one longitudinal edge of said spine, first and second ring members having inner and outer ends and rigidly joined at their inner ends to broad side surfaces of said first and second spine members, respectively, with the first and second ring members aligned in pairs spaced along said spine and the outer ring member ends of each pair aligned to form binder rings which are opened and closed by rotation of said said spine members and ring members substantially about said pivot axis between open positions wherein the aligned outer ring member ends are spaced to insert and remove loose leaf sheets into and from the binder and closed positions wherein the aligned outer ring member ends are juxtaposed to form closed binder rings, and wherein said spine members comprise plates having first longitudinal edges, means pivotally joining said plates along said longitudinal edges, and said plates having second longitudinal edges opposite their first longitudinal edges, and said spine comprises coacting releasible snap fastening means on said spine plates including a bead along the second longitudinal edge of one plate and a channel along the second longitudinal edge of the other plate receiving said bead with a releasible snap fit for releasibly securing said spine plates to one another when said spine plates occupy their closed positions, thereby to retain said binder rings closed.

16. A loose-leaf binder comprising:

an elongate spine having two opposite longitudinal edges, a major transverse dimension between said edges, and a substantially smaller minor transverse dimension normal to said major dimension, and said spine including first and second spine members which have relatively broad side surfaces between said spine edges and are relatively pivotally rotatable substantially about a longitudinal pivot axis adjacent one longitudinal edge of said spine, first and second ring members having inner and outer ends and rigidly joined at their inner ends to broad side surfaces of said first and second spine members, respectively, with the first and second ring members aligned in pairs spaced along said spine and the outer ring member ends of each pair aligned to form binder rings which are opened and closed by rotation of said said spine members and ring members substantially about said pivot axis between open positions wherein the aligned outer ring member ends are spaced to insert and remove loose leaf sheets into and from the binder and closed positions wherein the aligned outer ring member ends are juxtaposed to form closed binder rings, and wherein said spine comprises magnetic means for releasibly securing said spine members to one another when said spine members occupy their closed positions, thereby to retain said binder rings closed.

17. A loose-leaf binder comprising:

an elongate spine having two opposite longitudinal edges, a major transverse dfimension between said edges, and a substantially smaller minor transverse dimension normal to said major dimension, and said spine including first and second spine members which have relatively broad side surfaces between said spine edges and are relatively pivotally rotatable substantially about a longitudinal pivot axis adjacent one longitudinal edge of said spine, first and second ring members having inner and outer ends and rigidly joined at their inner ends to broad side surfaces of said first and second spine members, respectively, with the first and second ring members aligned in pairs spaced along said spine and the outer ring member ends of each pair aligned to form binder rings which are opened and closed by rotation of said said spine members and ring members substantially about said pivot axis between open positions wherein the aligned outer ring member ends are spaced to insert and remove loose leaf sheets into and from the binder and closed positions wherein the aligned outer ring member ends are juxtaposed to form closed binder rings, and wherein said spine members comprise plates having first longitudinal edges, means pivotally joining said plates along said longitudinal edges, said plates have second longitudinal edges opposite their first longitudinal edges, and said spine comprises a magnet along the second longitudinal edge of one plate and a magnetically permeable element along the second longitudinal edge of the other plate engagable with said magnet for releasibly securing said spine plates to one another when said spine plates occupy their closed positions, thereby to retain said binder rings closed.

18. A loose-leaf binder comprising:

an elongate spine having two opposite longitudinal edges, a major transverse dimension between said edges, and a substantially smaller minor transverse dimension normal to said major dimension, and said spine including first and second spine members which have relatively broad side surfaces between said spine edges and are relatively pivotally rotatable substantially about a longitudinal pivot axis adjacent one longitudinal edge of said spine, first and second ring members having inner and outer ends and rigidly joined at their inner ends to broad side surfaces of said first and second spine members, respectively, with the first and second ring members aligned in pairs spaced along said spine and the outer ring member ends of each pair aligned to form binder rings which are opened and closed by rotation of said said spine members and ring members substantially about said pivot axis between open positions wherein the aligned outer ring member ends are spaced to insert and remove loose leaf sheets into and from the binder and closed positions wherein the aligned outer ring member ends are juxtaposed to form closed binder rings, and wherein said spine comprises VELCRO fastening means for releasibly securing said spine members to one another when said spine members occupy their closed positions, thereby to retain said binder rings closed.

19. A loose-leaf binder comprising:

an elongate spine having two opposite longitudinal edges, a major transverse dimension between said edges, and a substantially smaller minor transverse dimension normal to said major dimension, and said spine including first and second spine members which have relatively broad side surfaces between said spine edges and are relatively pivotally rotatable substantially about a longitudinal pivot axis adjacent one longitudinal edge of said spine, first and second ring members having inner and outer ends and rigidly joined at their inner ends to broad side surfaces of said first and second spine members, respectively, with the first and second ring members aligned in pairs spaced along said spine and the outer ring member ends of each pair aligned to form binder rings which are opened and closed by rotation of said said spine members and ring members substantially about said pivot axis between open positions wherein the aligned outer ring member ends are spaced to insert and remove loose leaf sheets into and from the binder and closed positions wherein the aligned outer ring member ends are juxtaposed to form closed binder rings, and wherein said spine members comprise plates having confronting sides and longitudinal edges, and means pivotally joining said plates along said longitudinal edges, and said spine comprises coacting VELCRO hook and loop pads fixed to said confronting plate sides, respectively, for releasibly securing said spine plates to one another when said spine plates occupy their closed positions, thereby to retain said binder rings closed.

* * * * *